United States Patent [19]

Greuel, Jr.

[11] 4,372,796

[45] Feb. 8, 1983

[54] METHOD AND APPARATUS FOR WRAPPING A TAPE AROUND A PIPE

[75] Inventor: Walter J. Greuel, Jr., Pleasanton, Calif.

[73] Assignee: Raychem Corporation, Menlo Park, Calif.

[21] Appl. No.: 291,689

[22] Filed: Aug. 10, 1981

[51] Int. Cl.[3] ..... B65H 81/00

[52] U.S. Cl. ..... 156/187; 118/107; 156/425; 156/429

[58] Field of Search ..... 118/107, 108; 156/392, 156/187, 188, 428, 429, 446

[56] References Cited

U.S. PATENT DOCUMENTS

| | | | |
|---|---|---|---|
| 1,796,691 | 3/1931 | Jansen | 118/107 |
| 2,044,778 | 6/1936 | Halstead | 118/108 |
| 3,525,656 | 8/1970 | Kennedy | 156/188 |
| 3,761,335 | 9/1973 | Cichoski | 156/187 |

*Primary Examiner*—David A. Simmons
*Attorney, Agent, or Firm*—Timothy H. P. Richardson

[57] ABSTRACT

A method and apparatus for providing a substantially void-free tape wrapping around a pipe having a longitudinal weld bead protruding from the surface thereof. While the pipe is simultaneously advanced and rotated, liquid viscous sealing material is applied to the pipe, and the applied sealing material is then doctored by means of at least one doctor blade. The doctor blade faces the advancing pipe surface, with the axis of the doctor blade at an angle of about 10° to 50° to the axis of the pipe, and is urged against the pipe so that it is resiliently deformed by the pipe and accommodates passage of the weld bead underneath it. In this way the doctor blade doctors the sealing material so that it provides a smooth transition between the weld bead and the adjacent pipe surfaces. The tape is then spirally wrapped around the pipe. The invention is particularly useful when a heated sealing material, eg. a hot melt adhesive, is applied to a heated pipe which is subsequently wrapped with a heated polymeric tape having the same sealing material on its interior surface.

23 Claims, 5 Drawing Figures

METHOD AND APPARATUS FOR WRAPPING A TAPE AROUND A PIPE

BACKGROUND OF THE INVENTION

1. Field of the Invention

This invention relates to a method and apparatus for wrapping a tape around a pipe.

2. Summary of the Prior Art

It is well known to provide a pipe with a tape wrapping. Usually a polymeric tape is wrapped in a spiral overlapping manner around the pipe in order to provide environmental protection. A sealing material, eg. a hot melt adhesive, may be provided between the pipe and tape, by placing it on the pipe before it is wrapped or on the interior surface of the tape or both. The relative movement of the tape and the pipe required during the wrapping can be provided by spiralling a tape supply around a fixed pipe, by rotating a tape supply around a pipe which is advanced axially only, or by pulling tape from a fixed tape supply onto a pipe which is simultaneously advanced axially and rotated.

Certain types of metal pipe, especially those having relative large diameters, eg. greater than 18 inch, have a longitudinal weld bead protruding from the surface thereof (eg. double submerged arc weld, DSAW, pipes). Such pipes present problems when tape wrapped, because the tape tends to form a tent over the weld bead, leaving two longitudinal voids, one each side of the weld bead. These voids are undesirable, especially because they provide sites for accumulation of moisture. Various methods have been proposed for overcoming this difficulty, but all suffer from serious disadvantages. For example, attempts have been made to use rollers to press the tape wrapping into the grooves on either side of the weld bead, but most tape wraps are too resilient for this to be successful. In another method the grooves are filled with a sealing material, before the tape wrap is applied, by forwarding the pipe axially only (i.e. not simultaneously rotating it), applying a viscous liquid sealing material to the area around the weld bead and doctoring the sealing material by means of a doctor blade placed generally at right angles to the axis of the pipe; the tape is then applied by spiralling a tape supply around the pipe as it is forwarded axially only. This method requires that the weld bead be accurately positioned before the process begins. Furthermore it is much more difficult to obtain good tape wrapping by spiralling the tape supply around the pipe then when the pipe is rotated, especially when the pipe and the tape are heated. The tape wrapping can be performed in a separate operation in which the pipe is simultaneously rotated and forwarded, but this is inconvenient, and furthermore the tires (or other means) used to rotate the pipe deform the sealant which has been doctored into the grooves, especially if the pipe and sealant are heated.

SUMMARY OF THE INVENTION

I have now discovered an improved method of providing a substantially void-free tape wrapping around a longitudinally welded metal pipe having a longitudinal weld bead protruding from the surface thereof, which method comprises:

(1) simultaneously advancing the pipe at a constant rate in its axial direction and rotating the pipe at a constant rate about its axis;

(2) applying a viscous liquid sealing material to the outer surface of the pipe, as the pipe is advanced and rotated;

(3) passing the pipe, as it is advanced and rotated and after the sealing material has been applied to the surface thereof, past at least one doctor blade which doctors the sealing material to provide a smooth transition between the top of the weld bead and the adjacent outer surface of the pipe, the doctor blade being urged, preferably resiliently urged, against the surface of the pipe so that the doctor blade is resiliently deformed to conform generally to the shape of the pipe and to accommodate passage underneath it of the weld bead of the pipe, the doctor blade facing the advancing pipe surface and the mean angle of the axis of the doctor blade to the axis of the pipe, $\phi$, being such that $1>\tan(\phi-5)>d/c$, where d is the axial distance which the pipe advances as it is rotated once, and c is the exterior circumference of the pipe; and (4) wrapping a tape in a spiral overlapping manner around the pipe, as the pipe is advanced and rotated and after it has passed the doctor blade.

The invention also includes apparatus suitable for carrying out the method defined above, the apparatus comprising:

(1) forwarding means for simultaneously advancing and rotating a pipe;

(2) application means for applying a viscous liquid sealing material to the pipe;

(3) doctoring means to doctor the sealing material, the doctoring means comprising (a) at least one resiliently deformable doctor blade, and (b) urging means for urging the doctor blade against the surface of the pipe, the urging means being adjustable so that the doctor blade (i) can be set to face the advancing pipe surface, with the axis of the doctor blade being at a fixed angle which is between 10° and 50° to the axis of the pipe and (ii) can be pressed against the pipe so that it is resiliently deformed to conform generally to the shape of the pipe; and (4) tape supply means for applying a spiral overlapping tape wrap to the coated pipe after it has been doctored by the doctor means.

BRIEF DESCRIPTION OF THE DRAWINGS

The invention is illustrated in the accompanying drawings in which.

DETAILED DESCRIPTION OF THE INVENTION

Figure 1:
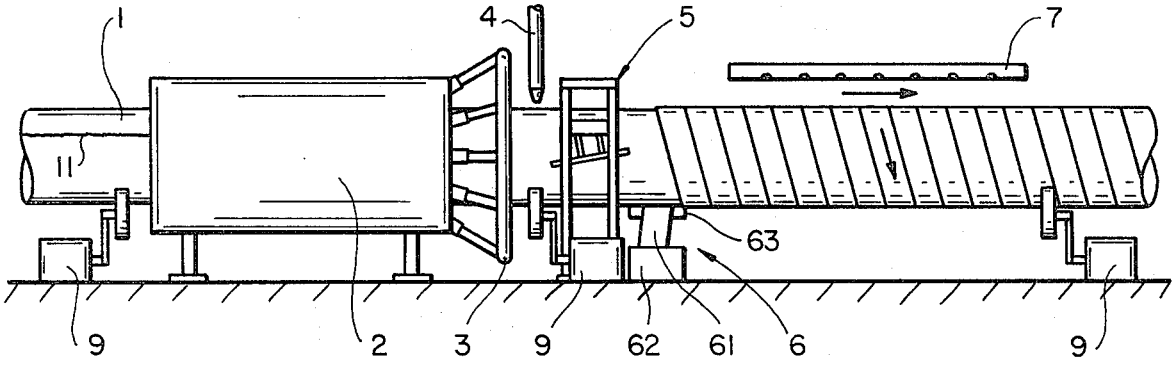
FIG. 1 is a view of the process of the invention.

A single doctor blade is sufficient to carry out the process of the invention, provided it is sufficiently long to sweep the entire surface of the pipe; the or each doctor blade preferably has a length of at least $1.5\times d$, especially at least $2\times d$, where d is the axial distance which the pipe advances as it is rotated once. However, it is often preferred to use two (or more) doctor blades (which can be the same or different) which are circumferentially spaced-apart from each other and which are preferably longitudinally (i.e. axially) positioned so that the section of the pipe which passes under the trailing end of each doctor blade subsequently passes under a central section of another doctor blade (by a "central section" is meant a section which is at least $0.1 \times l$, preferably at least $0.25 \times l$, where l is the length of the doctor blade, from each end of the doctor blade). In this way any tendency for a trailing end of a blade to leave an imperfection in the coating (and in particular in the region of the weld bead) can be corrected. When two or more doctor blades are used, their total combined length is preferably at least $2 \times d$, especially at least $3 \times d$.

The doctor blade must be resiliently flexible so that it will conform generally to the surface of the pipe and accommodate passage of the weld bead underneath it. It must also be strong enough to doctor the viscous sealing material, and thus retain a bank of the sealing material between it and the advancing pipe. I have found stainless steel to be a suitable material for the doctor blade. For doctoring a hot melt adhesive applied to a pipe of diameter about 36 inches, I believe that it will be satisfactory to use a doctor blade about 24 inches long and 4 inches high and cut from stainless steel sheet of 18 to 26 gauge, eg. 18, 22, 24, or 26 gauge.

The operation of the doctor blade is affected by the angle, $\alpha$, between the surface of the doctor blade and the advancing pipe surface as it passes under the doctor blade, which is preferably 20° to 80°, especially 30° to 60°. The smaller the angle $\alpha$, the more likely it is that the sealant will deform the blade and creep under it; the larger the angle $\alpha$, the more rigid the blade in operation and therefore the less likely that the desired conformance between blade and pipe will be achieved.

The angle, $\phi$, between the axis of the doctor blade and the axis of the pipe, also affects the operation of the doctor blade, and is preferably from 10° to 40°, particularly 15° to 30°, especially about 20°. If $\phi$ is too small, sealing material tends to spill off the leading end of the blade, and if $\phi$ is too large the blade cannot conform sufficiently to the pipe surface.

Any viscous liquid sealing material can be used in the invention, but the invention is particularly useful when a hot sealant, eg. at a temperature of at least 100° C., eg. a hot melt adhesive, is used. Suitable sealants include for example hot-melt adhesives of melt index at 150° C. in the range of 30 to 130, eg. 50–55, applied at temperatures in the range of 150° to 240° C. eg. 175° to 220. When using hot sealants the pipe is usually also heated, eg. to a temperature of at least 100° C. In the process of the invention the sealant is doctored into smooth coating all over the pipe, the coating being of uniform thickness except in the area of the weld bead, where the thickness of the sealant is greater in the grooves either side of the weld bead, and less over the top of the weld bead.

The pipes used in this invention may be of any size, but pipes having longitudinal weld beads are usually at least 15 inches, e.g. 24 to 48 inches, in diameter.

The tape used in the invention is usually a polymeric tape, often one having a coating of a sealing material on its interior surface. The sealing material is preferably the same as that applied to the pipe and doctored by the doctor blades. When a hot melt adhesive is used as the sealant, the tape and adhesive coating are preferably heated before being applied to the pipe.

Referring now to the drawings, in which the same numerals are used to denote like components, FIG. 1 shows a pipe 1 having weld bead 11, the pipe being simultaneously advanced axially and rotated by drive wheels 9. The pipe is forwarded sequentially through an oven 2, in which the pipe is heated; through heat shield 3; past extrusion nozzle 4 through which molten hot-melt adhesive is extruded onto the pipe; through doctoring station 5 (shown in more detail in FIGS. 2 and 3) in which the adhesive is doctored to a uniform exterior finish; through tape-wrapping station 6 in which tape 61 having a coating of hot melt adhesive is drawn from tape supply 62 and is applied in spiral overlapping fashion to the pipe 1 with the aid of roller 63; and finally under cooling spray 7.

Figure 2:
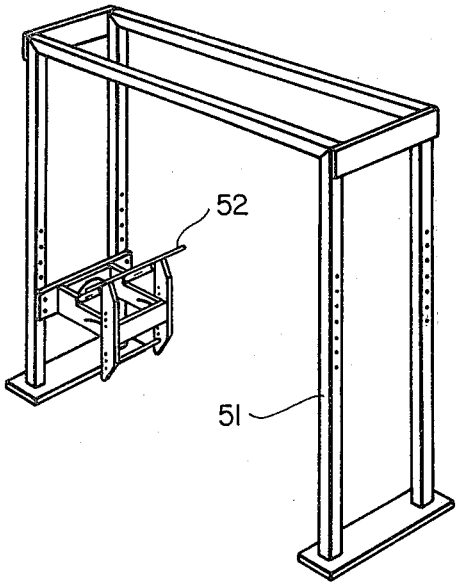
FIG. 2 is a more detailed view of the doctoring means of FIG. 1.
Figure 3:
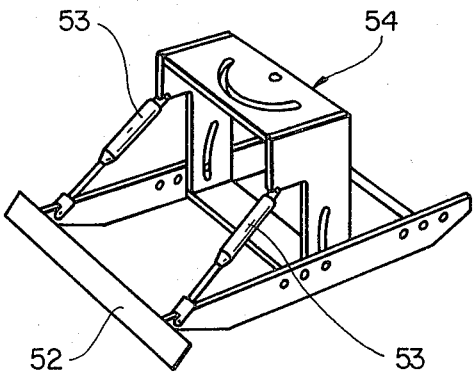
FIG. 3 is a yet more detailed view of part of FIG. 2.

FIGS. 2 and 3 show the doctoring station 5 in more detail. Frame 51 carried a pair of identical doctor blade assemblies (as shown in greater detail in FIG. 3) which press doctor blades against diametrically opposed parts of the pipe. Only one of the blade assemblies is shown in FIG. 2. Doctor blade 52 is resiliently urged against the pipe surface by means of spring-loaded pistons 53 which form part of three-dimensionally adjustable sub-frame 54.

Figure 4:
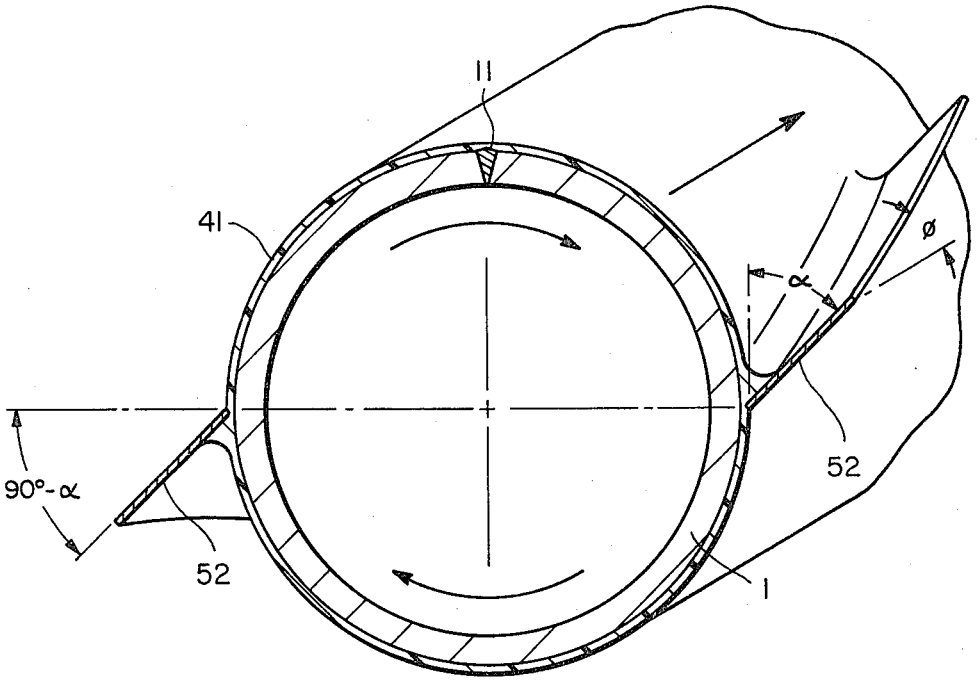
FIG. 4 is an end view, partly in cross-section, of the pipe as it passes under the doctor blades.
Figure 5:
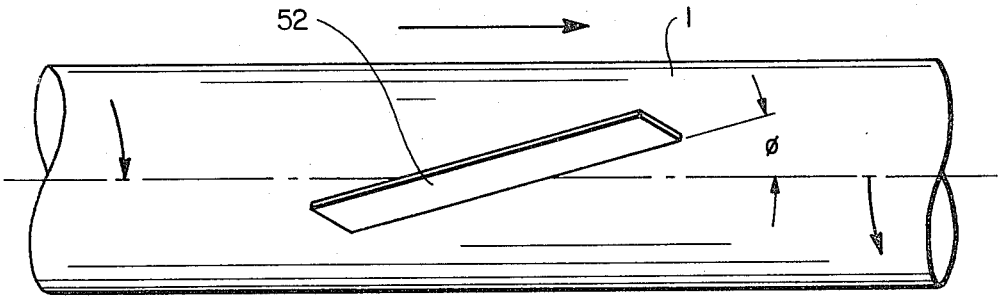
FIG. 5 is a side view of the pipe as it passes under the doctor blade.

FIGS. 4 and 5 clarify the angular relationships between the doctor blades 52 and the pipe 1, in particular the angles $\alpha$ and $\phi$. Also shown in FIG. 4 is a coating 41 of hot melt adhesive, varying in thickness in the region of the weld bead 11.

I claim:

1. A method of providing a substantially void-free tape wrapping around a longitudinally welded metal pipe having a longitudinal weld bead protruding from the surface thereof, which method comprises:

(1) simultaneously advancing the pipe at a constant rate in its axial direction and rotating the pipe at a constant rate about its axis;

(2) applying a viscous liquid sealing material to the outer surface of the pipe, as the pipe is advanced and rotated;

(3) passing the pipe, as it is advanced and rotated and after the sealing material has been applied to the surface thereof, past at least one doctor blade which doctors the sealing material to provide a smooth transition between the top of the weld bead and the adjacent outer surface of the pipe, the doctor blade being urged against the surface of the pipe so that it is resiliently deformed to conform generally to the shape of the pipe and to accommodate passage underneath it of the weld bead of the pipe, the doctor blade facing the advancing pipe surface, the mean angle of the axis of the doctor blade to the axis of the pipe, $\phi$, being such that $1 > \tan(\phi - 5) > (d/c)$ where d is the axial distance which the pipe advances as it is rotated once, and c is the exterior circumference of the pipe and the angle between the surface of the doctor blade facing the advancing pipe surface and the surface of the pipe as it passes under the doctor blade, $\alpha$, being from 20° to 80°; and (4) wrapping a tape in a spiral overlapping manner around the pipe, as the pipe is adanced and retated and after it has passed the doctor blade.

2. A method according to claim 1 wherein the sealing material is doctored by means of at least one doctor blade having a length of at least $1.5 \times d$, where d is the axial distance which the pipe advances as it is rotated once.

3. A method according to claim 1 wherein the doctor blade has a length of at least $2 \times d$.

4. A method according to claim 1 wherein the sealing material is doctored by means of a plurality of circumferentially spaced-apart doctor blades whose total combined length is at least 2×d.

5. A method according to claim 4 wherein the combined length of the doctor blades is at least 3×d.

6. A method according to claim 4 wherein the sealing material is doctored by means of a plurality of identical doctor blades.

7. A method according to claim 1 wherein the sealing material is doctored by means of a plurality of circumferentially spaced-apart doctor blades which are longitudinally positioned so that the section of the pipe which passes under the trailing end of each doctor blade subsequently passes under a central section of another doctor blade.

8. A method according to claim 1 wherein $\phi$ is from 10° to 40°.

9. A method according to claim 8 wherein $\phi$ is from 15° to 30°.

10. A method according to claim 9 wherein $\phi$ is about 20°.

11. A method according to claim 1 wherein $\alpha$ is from 30° to 60°.

12. A method according to claim 1 wherein each doctor blade is composed of stainless steel and has a gauge of 18 to 26.

13. A method according to claim 1 wherein in step (2) a heated sealing material is applied to a heated pipe.

14. A method according to claim 13 wherein in step (2) sealing material at a temperature of at least 100° C. is applied to a pipe which is at a temperature of at least 100° C.

15. A method according to claim 13 wherein in step (4) the tape which is wrapped around the pipe is heated and has a coating, on the surface thereof which contacts the pipe, of a heated sealing material which is the same as the sealing material applied to the pipe in step (2).

16. A method according to claim 15 wherein the heated sealing material is a hot melt adhesive.

17. A method according to claim 1 wherein in step (4) the tape which is wrapped around the pipe has a coating of a sealing material on the surface thereof which contacts the pipe.

18. A method of providing a substantially void-free tape wrapping around a longitudinally welded metal pipe having a longitudinal weld bead protruding from the surface thereof, which method comprises:

(1) simultaneously advancing a heated pipe at a constant rate in its axial direction and rotating the pipe at a constant rate about its axis;

(2) extruding a molten hot-melt adhesive onto the outer surface of the pipe, as the pipe is advanced and rotated;

(3) passing the pipe, as it is advanced and rotated and after the adhesive has been applied to the surface thereof, past at least one doctor blade which doctors the sealing material to provide a smooth transition between the top of the weld bead and the adjacent outer surface of the pipe, the doctor blade being urged against the surface of the pipe so that the doctor blade is resiliently deformed to conform generally to the shape of the pipe and to accommodate passage underneath it of the weld bead of the pipe, the doctor blade facing the advancing pipe surface, the mean angle of the axis of the doctor blade to the axis of the pipe, $\phi$, being from 10° to 40° and the angle between the surface of the doctor blade facing the advancing pipe surface and the surface of the pipe as it passes under the doctor blade, $\alpha$, being from 20° to 80°; and (4) wrapping a tape in a spiral overlapping manner around the pipe, as the pipe is advanced and rotated and after it has passed the doctor blade, the tape being a heated polymeric tape having a coating on the interior surface thereof of a hot-melt adhesive.

19. A method according to claim 18 wherein the sealing material is doctored by means of a plurality of circumferentially spaced-apart doctor blades whose total combined length is at least 2×d, where d is the axial distance which the pipe advances as it is rotated once, and which are longitudinally positioned so that the section of pipe which passes under the trailing end of each doctor blade subsequently passes under a central section of another doctor blade.

20. A method according to claim 19 wherein each doctor blade is composed of stainless steel and has a gauge of 18 to 26.

21. A method according to claim 18 wherein the angle $\phi$ is 15° to 30°.

22. A method according to claim 21 wherein the angle $\alpha$ is from 30° to 60°.

23. Apparatus for wrapping a tape around a pipe which comprises:

(1) forwarding means for simultaneously advancing a pipe at a constant rate in its axial direction and rotating the pipe at a constant rate about its axis;

(2) heating means for heating a pipe as it is advanced and rotated by the forwarding means;

(3) extrusion means for extruding a hot-melt adhesive onto the surface of a pipe heated by the heating means;

(4) doctoring means to doctor hot-melt adhesive applied to a pipe by the extrusion means, said doctor means comprising:

(a) at least two resiliently deformable doctor blades;

(b) urging means for resiliently urging each of the doctor blades against the surface of a pipe which is being advanced and rotated by the forwarding means, said urging means being adjustable so that each doctor blade (i) can be set to face the advancing pipe surface, with the axis of the doctor blade being at a fixed angle to the axis of the pipe which is between 15° and 30° and the angle between the surface of the doctoring blade facing the advancing pipe surface and the surface of the pipe as it passes under the doctor blade, $\alpha$, being from 20° to 80° and (ii) can be pressed against the pipe so that it is resiliently deformed to conform generally to the shape of the pipe;

said doctor blades being circumferentially spaced-apart and longitudinally positioned so that when an adhesive-bearing pipe is forwarded through the doctoring means, the section of the pipe which passes under the trailing end of each doctor blade subsequently passes under a central section of another doctor blade; and (5) tape supply means for applying a spiral tape wrap to a coated pipe after it has been doctored by the doctoring means.

* * * * *